US006079959A

United States Patent [19]

Kingsford et al.

[11] Patent Number: 6,079,959

[45] Date of Patent: Jun. 27, 2000

[54] RECIPROCATING PUMP

[75] Inventors: Kenji A. Kingsford, Devore; Anthony K. T. Chan, San Gabriel; David L. Henderson, Highland; Van Trong Tran, Diamond Bar; David R. Martinez, Corona, all of Calif.

[73] Assignee: Saint-Gobain Performance Plastics Corporation, Wayne, N.J.

[21] Appl. No.: 09/061,499

[22] Filed: Apr. 16, 1998

Related U.S. Application Data

[63] Continuation-in-part of application No. 08/683,528, Jul. 15, 1996, abandoned.

[51] Int. Cl.[7] ..... F09B 35/00; F09B 23/04

[52] U.S. Cl. ..... 417/393; 417/397; 417/533; 417/536; 417/454; 92/980

[58] Field of Search ..... 417/393, 395, 417/397, 403, 404, 63, 473, 533–536; 92/98 D; 137/883, 895

[56] References Cited

U.S. PATENT DOCUMENTS

| | | | |
|---|---|---|---|
| 879,660 | 2/1908 | Lepley | 417/536 |
| 2,391,703 | 12/1945 | Hughes | 417/395 |
| 2,675,758 | 4/1954 | Hughes | 417/395 |
| 2,711,134 | 6/1955 | Hughes | 417/395 |
| 3,183,840 | 5/1965 | Conover | 417/521 |
| 3,386,384 | 6/1968 | Potts | 417/534 |
| 4,123,204 | 10/1978 | Scholle | 417/393 |
| 4,773,305 | 9/1988 | Nissels | 92/98 D |
| 4,778,356 | 10/1988 | Hicks | 417/397 |
| 4,818,191 | 4/1989 | Schlake | 417/397 |
| 4,981,418 | 1/1991 | Kingsford et al. | 417/397 |
| 5,062,770 | 11/1991 | Story et al. | 417/63 |
| 5,468,128 | 11/1995 | Benalikhodja | 417/413.1 |
| 5,769,614 | 6/1998 | Karasawa | 417/403 |
| 5,775,884 | 6/1998 | Westmoreland et al. | 417/454 |

FOREIGN PATENT DOCUMENTS

| | | | |
|---|---|---|---|
| 52-48107 | 4/1977 | Japan | 417/393 |
| 191353 | 1/1967 | Russian Federation | 417/393 |

OTHER PUBLICATIONS

Bellofram Corporation, "Diaphragm Design Manual", Dec. 1982, pp. 1–32.

*Primary Examiner*—Charles G. Freay
*Attorney, Agent, or Firm*—Christie, Parker & Hale, LLP

[57] ABSTRACT

Pumps of this invention comprise a pump housing having at least one pressurizing chamber disposed therein, and a pressurizing member is disposed within the pressurizing chamber. The pressurizing member has a body with a solid imperforate head at one end, a thin-walled skirt extending away from the body head, and a flange extends circumferentially around a terminal edge of the skirt. A piston is disposed within the pump housing and is connected at one end to the pressurizing member. A piston gland is attached to the chamber and includes a diametrically positioned piston guide through which the piston is disposed. The flange is interposed between the chamber and the piston gland and includes sealing means to provide a fluid-tight seal therebetween. A pressurizing member plug is attached to the pressurizing member and has an outside wall surface that contacts and carries a variable portion of the skirt inside surface during reciprocating pressurizing member axial displacement. The thin-wall skirt has a sufficient axial length to roll between the plug outside wall surface and the gland inside diameter to permit pressurizing member reciprocating axial displacement within the pressurizing chamber.

25 Claims, 7 Drawing Sheets

RECIPROCATING PUMP

CROSS-REFERENCE TO RELATED APPLICATIONS

This patent application is a continuation-in-part of U.S. patent application Ser. No. 08/683,528 filed on Jul. 15, 1996.

FIELD OF THE INVENTION

The present invention relates generally to reciprocating pumps and, more particularly, to reciprocating pumps having chemically inert wetted areas that use rolling diaphragm pressurizing members, and to pump systems comprising one or more of such pumps that are operated to produce a substantially flat overall discharge pressure.

BACKGROUND OF THE INVENTION

Pumps that are useful in the semi-conductor manufacturing industry must be capable of transferring high purity process fluids that are oftentimes corrosive and/or caustic. These high purity process fluids are oftentimes heated to temperatures near their boiling point to increase their efficiency in performing the particular semiconductor manufacturing process. Accordingly, it is important that pumps placed into service with such process fluids be capable of transferring such corrosive and/or caustic process fluids under high-temperature conditions without failing. It is also important that pumps placed into such service do not introduce contaminant matter that can be transferred downstream, which could eventually damage or contaminate the high-purity finished product, e.g., semiconductors and the like.

Conventional pumps that are well known for their application in other less demanding applications are not well suited for use in applications where maintaining the high purity of the process fluid is important. For example, rotary or centrifugal pumps, that rely on the use of a rotating impeller to increase the output pressure of fluid entering the pump, are not well suited for use in high-purity systems because of the potential for the process fluid to come into contact with the impeller bearings upon failure of the bearing packing or pump seal. Exposing the process fluid to the bearings introduces contamination leaving the pump in the form of metal particles, into the process fluid resulting in contamination of the final product. Also, reciprocating piston-type pumps that use dynamic seals around the piston circumference are similarly unsuited for high-purity applications because of the abrasion and wear that occurs at the dynamic piston seal, which results in particulate matter from the worn and abraded seal entering and contaminating the process fluid.

Pumps that have been used in such high-purity service with some degree of success include both diaphragm- and bellows-type pumps. Diaphragm pumps rely on the reciprocating movement of a flexible diaphragm within a chamber to both receive and discharge at pressure the process fluid. The diaphragm for such service can be made from a chemically inert material and is usually fixed about a circumferential edge along the pressure chamber wall. The pressure chamber is configured having inlet and outlet ports that are fitted with one-way check valves so that moving the center portion of the diaphragm in one direction causes fluid to enter the chamber via the inlet port, and moving the diaphragm in the opposite direction causes fluid to exit the chamber via the outlet port. The resulting pressure output produced by the diaphragm pump fluctuates from zero to some desired level, and is not flat. The diaphragm in a diaphragm pump is attached to the pump housing about a peripheral edge, and is attached to an actuating piston by a hole disposed through a center portion of the diaphragm body. This hole serves as an additional leak path, other than that provided at the peripheral seal, for the migration of process fluid past the diaphragm and into the inner workings of the pump where it can be exposed to particulate or other contaminate matter. Fluid passing back through the leak path from the housing can thereby contaminate the remaining process fluid.

Further, the reciprocating movement of the diaphragm is known to place large stresses both upon unsupported areas of the diaphragm and at the point of attachment with the chamber, causing the diaphragm to ultimately fail by rupture or collapse after a relatively short service time. Diaphragm failure not only terminates process fluid transfer but also exposes the process fluid to metallic surfaces and metal particles from parts used to move the diaphragm, e.g., the piston rod, rod bearing and the like, contaminating the high-purity process and possibly contaminating the final product.

Bellows-type pumps rely on the reciprocating movement of a piston-shaped bellows within a closed chamber to both receive process fluid into a pressure chamber and discharge it under pressure. The bellows can be formed from a chemically inert material and is attached along a circumferential skirt to the chamber wall. The advantage of a bellows pressurizing member over a diaphragm is that in theory the bellows is not stressed to the same degree as a diaphragm during reciprocating movement. Rather, the bellows moves within the chamber by the expansion and contraction of its accordion-like cylindrical wall. However, the bellows pump, like the diaphragm pump, also does not have a relatively flat or constant output pressure.

It is also known that the accordion-like cylindrical wall of the bellows is prone to fatigue and failure due to wall thickness nonuniformnities that are inherent in the bellows manufacturing process. Such wall thickness nonuniformities cause the thinnest portion of the accordion-like cylindrical wall to flex the most during reciprocating movement, and ultimately fail due to fatigue stress, thereby limiting the service life of the pump. To ensure accordion-like expansion and contraction movement, and to prevent collapse of the cylindrical wall, the bellows can be supported along the inside wall surface by metal windings. The metal windings prevent the cylindrical wall from collapsing during reciprocating movement. However, upon failure of the accordion-like cylindrical wall, process fluid is free to contact the metal windings, thereby contaminating the process.

Additionally, pumps are used in the semi-conductor manufacturing industry to transport a ultrapure slurry comprising abrasive particles in suspension for such grinding and polishing operations as chemical mechanical planarization. Convention pumps that are used to transport such abrasive slurries are prone to failure caused by the abrasion of the pump wetted surfaces by the slurry material. Typically, the pressurizing member of conventional diaphragm pumps used in slurry transport service undergoes accelerated abrasive wear due to contact with the slurry abrasive particulate matter. Pumps constructed having one or more dynamic seal are also known to fail due to accelerated abrasion wear along the dynamic seal surface. The abrasive wear of such pump components in contact with the slurry material not only cause the pump to fail within a shortened service life, but introduce contaminate material into the ultrapure slurry material being transported, thereby introducing contaminate material into the downstream processes and onto the object being manufactured. Once the pump fails or the system becomes contaminated by abraded pump components, the process must be shut down, the pump repaired, and the system flushed, thereby adding undesired time and cost to the manufacturing process.

It is, therefore, desirable that a pump be constructed that is capable of pressurizing both high and low temperature high-purity process fluid without the possibility of fluid contamination. It is desirable that the pump be constructed in a manner that both minimizes the possibility of internal leakage and is capable of providing an indication of internal leakage. It is desired that the pump be constructed to function in slurry transport service and have an extended service life when compared to conventional pumps subjected to such service. It is also desired that the pump be capable of being operated to provide a substantially constant output pressure, or a pump system be constructed of a plurality of such pumps that is capable of providing a relatively constant overall pressure output and be fault tolerant, i.e., capable of adjusting system operation to maintain a relatively constant discharge pressure when internal pump leakage is detected.

SUMMARY OF THE INVENTION

Reciprocating pumps, constructed according to principles of this invention, are capable of pressurizing both high and low temperature high-purity process fluid without the possibility of fluid contamination. Such pumps are constructed having only a single leak path from each pressurizing chamber to, thereby minimize the possibility of internal leakage, and are constructed to permit leak detection in the event that any leakage does occur.

Pumps of this invention comprise a pump housing having at least one pressurizing chamber disposed therein, wherein the pressurizing chamber comprises a substantially closed chamber end at one axial end and an open chamber end at an opposite axial end, and wherein the substantially closed chamber end is in hydraulic connection with a fluid transport passageway. A pressurizing member is disposed within the pressurizing chamber, the pressurizing member having a one-piece construction formed from a fluoropolymeric material. The pressurizing member comprises a generally cylindrical body having a solid imperforate head at one body end that is positioned adjacent the closed chamber end. A thin-walled skirt extends away from the body head and includes an inner and outer surface. A flange extends circumferentially around a terminal edge of the skirt.

A piston is disposed axially within the pump housing and is connected at one end to the pressurizing member. A piston gland is attached to the open pump chamber end and has an inside diameter that is complementary to that of the pressurizing chamber. The piston gland includes a diametrically extending portion with a piston opening for accommodating the piston therethrough. The pressurizing member flange is interposed between the pressurizing chamber and the piston gland and includes sealing means to provide a fluid-tight seal therebetween. A pressurizing member plug is attached to the pressurizing member and extends a distance axially away from the body head towards the piston, the plug has an outside wall surface that contacts and carries a variable portion of the skirt inside surface during reciprocating pressurizing member axial displacement.

The pressuring member thin-wall skirt has a sufficient axial length to roll between the plug outside wall surface and the gland inside diameter to permit pressurizing member reciprocating axial displacement within the pressurizing chamber. The thin-walled skirt inside surface is rolled from the plug to the gland during a pressurizing member intake stroke, and is moved from the gland to the plug during a pressurizing member output stroke.

Exemplary pumps of this invention comprise a pair of pressurizing members each disposed within a respective chamber. In one embodiment, such pump may have the pressurizing chambers arranged horizontally at opposite ends of the pump housing with a common piston attached at opposite ends to the pressurizing members to provide joined reciprocating displacement. In another embodiment, such pump may have the pressurizing chambers arranged vertically side-by-side of one another in the pump housing with independent pistons attached to respective pressurizing members to provide independent reciprocating displacement.

DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

This invention relates to pumps useful for transferring process fluids, and more specifically, to reciprocating pumps useful for transferring high-purity process fluids and slurries such as those used in the semiconductor manufacturing industry. The pumps include internal wetted elements that are made from chemically inert materials that are resistant to corrosive, abrasive, and caustic process fluids, are not formed from metal, and are constructed without the use of dynamic seals. In one pump embodiment the pump is of a reciprocating design, comprising symmetrically opposed pressurizing chambers. In such embodiment, the pump comprises a pair of opposed reciprocating pressurizing chambers that are pneumatically actuated in an opposed sequence so that at any instant one pressurizing chamber is pressurizing the process fluid and the other is receiving the process fluid. A pump system, constructed according to principles of this invention comprises a number of such pumps that are each actuated at different sequencing intervals so that the overall combined pressure output from the pumps is relatively constant. In another embodiment, the pump of this invention comprises a pair of vertically arranged pressurizing chambers that each comprise a separate pressurizing member that are each actuated independently to achieve a substantially constant output pressure.

Figure 1:
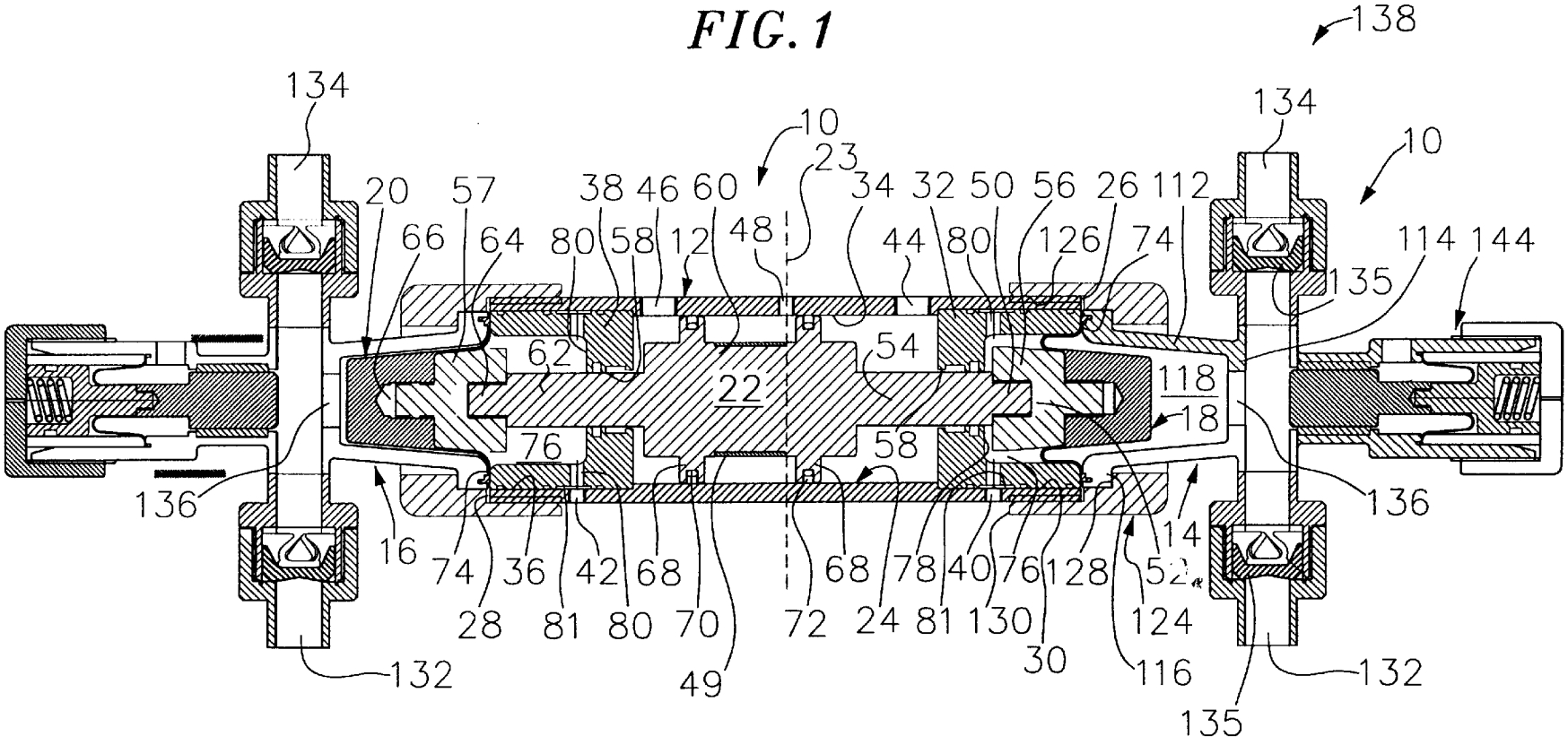
FIG. 1 is a cross-sectional side elevational view of a reciprocating pump constructed according to principles of this invention.

Referring to FIG. 1, an exemplary embodiment of a pump 10 constructed according to principles of this invention is shown. The pump 10 comprises a housing 12, chamber heads 14 and 16 at opposite ends of the housing 12, pressurizing members 18 and 20 disposed within each respective chamber head 14 and 16, and an actuating piston 22 disposed within the housing and connected at opposite ends to the pressurizing members 18 and 20. Generally speaking, the pump 10 is symmetrically configured along a line 23 extending through the midpoint of the housing 12.

The housing 12 is generally cylindrical in shape, having an annular passage 24 that extends therethrough from a first open end 26 to an opposed second open end 28. The housing can be formed from any type of structurally rigid material of construction such as plastic, polymeric material, composites, metal and metal alloys, and the like. In low-temperature operations, e.g., below about 40° C., the housing can be made from a molded or machined polymeric material, such as polypropylene and the like. However, in high-temperature operations, above about 40° C., it is desired that the housing be made from metal or metal alloy such as stainless steel and the like to avoid any temperature induced structural weakness or deformation.

Moving across FIG. 1 from the right-hand side to the left-hand side, the annular passage 24 adjacent the first open end 26 has a first diameter section 30 that extends axially into the passage 24 a distance from the first end 26 to accommodate placement of a first piston gland 32 therein. Moving axially from the first diameter section 30, the annular passage 24 includes a reduced diameter section 34 that extends axially across the middle of the passageway 24 to a second diameter section 36 that extends to the second open end 28. Like the first diameter section 30, the second diameter section 36 is sized to accommodate placement of a second piston gland 38 therein. As discussed in greater detail below, the first and second diameter sections are sized having a diameter larger than the reduced diameter section 34 to limit the maximum inwardly directed axial travel of respective first and second piston glands 32 and 38 within the annular passage by seated placement against axial edges of the reduced diameter section.

The first and second diameter sections 30 and 36 each include at least one respective leak port 40 and 42 that extends through the housing wall. The reduced diameter section 34 includes two air inlets 44 and 46 that each extend through the housing wall and that are each positioned adjacent the respective passageway first and second diameter sections 30 and 36. In a preferred embodiment, the annular passage 24 also includes a piston indicator port 48 that extends through the housing wall at a middle position of the housing. The piston indicator port 48 is adapted to accommodate placement of a sensor (not shown) therein to monitor the position of the actuating piston 22 within the annular passage, and to control reciprocating actuation of the piston. The piston 22 includes placement monitoring means 49 in the form of black perfluoroalkoxy fluorocarbon resin shrink tubing disposed around the piston. The black surface of the piston is picked up by a sensor mounted in the indicator port 48 to provide an indication of piston position within the housing.

The actuating piston 22 is disposed within the enlarged diameter section 34 of the annular passage and is symmetrically constructed comprising, moving from right to left in FIG. 1, a first diameter section 50 extending axially a distance from a first piston end 52, and a second diameter section 54 that extends axially a distance from the first diameter section 50. The actuating piston 22 has a generally cylindrical shape and can be formed from any type of structurally rigid material, such as those materials previously described above for the housing, and in addition fluoropolymeric compounds selected from the group consisting of tetrafluoroethylene (TFE), polytetrafluoroethylene (PTFE), fluorinated ethylene-propylene (FEP), perfluoroalkoxy fluorocarbon resin (PFA), polychlorotrifluoroethylene (PCTFE), ethylenechlorotrifluoroethylene copolymer (ECTFE). ethylene-tetrafluoroethylene copolymer (ETFE), polyvinylidene fluoride (PVDF), polyvinyl fluoride (PVF) and the like. In a preferred embodiment, the piston is formed from a non-metallic material, preferably polypropylene, to avoid possible process fluid contamination from the introduction of metal particles.

The first diameter section 50 is configured to accommodate attachment with a pressurizing member plug 56 that is attached to the pressurizing member 18. In a preferred embodiment, the first diameter section 50 is threaded to permit threaded attachment with the plug 56. The second diameter section 54 has a diameter that is greater than the first diameter section 50, and that is sized to accommodate axial displacement within a passageway 58 that extends through the first piston gland 32.

The piston 22 includes an enlarged diameter section 60 that extends axially from the second diameter section 54 and defines a central portion of the piston. The piston 50 is symmetrically constructed about a midpoint running diametrically across the enlarged diameter sections. Thus, the left hand portion of the piston comprises third and forth diameter sections 62 and 64 that extend from the enlarged diameter section to a second piston end 66. The third and fourth diameter sections have a size and configuration that is identical to the respective second and first piston diameter sections 54 and 50.

The enlarged diameter section 60 is larger in diameter than the second and third diameter sections 54 and 62 and includes at least one sealing flange 68 that extends circumferentially therearound. The sealing flange 68 includes a groove 70 positioned radially therein and has a diameter that is slightly smaller than the diameter of the enlarged diameter section 34 of the annular passage 24. In a preferred embodiment, a dual seal arrangement is used with the groove 70 to provide an air-tight seal between the annular passage 24 and the piston 22. The dual seal arrangement comprises an O-ring seal 71 that is disposed within the groove 70, and a ring-seal 72 that is disposed within the groove 70 over the O-ring seal. The O-ring seal 71 is used as an energizer to force the ring-seal 72 into contact against the adjacent wall of the annular passage 24. Alternatively, it is to be understood that a single seal arrangement can be used.

The seal can be formed from well known sealing materials such as elastomeric materials and the like. In a preferred embodiment, the O-ring seal 71 is made from suitable fluoroelastomers such as Viton, for low-temperature operations, or Kalrez, for high-temperature operations, both of which are available from DuPont of Wilmington Delaware. A preferred ringseal 72 material is a filled PTFE.

In the event that the piston comprises only one sealing flange 68, the sealing flange is axially positioned at the center of the enlarged diameter section 60. In the event that two sealing flanges are used, each is positioned adjacent opposing axial ends of the piston enlarged diameter section 60. In a preferred embodiment, the piston 22 comprises two sealing flanges 68. A piston construction having dual sealing flange is desired because it both allows for piston centerline sensing and provides an unpressurized area for the piston indicator port 48 and piston sensor.

The first and second piston glands 32 and 38 are each identically sized and configured, so it is understood that the following description applies equally to each. The piston glands are formed from a suitable structurally rigid material, such as those previously described for forming the housing and the piston. In low-temperature applications of less than about 40° C., the piston glands may be made from non-metallic materials, and are preferably made from PTFE. In high-temperature applications above about 40° C., the pistons glands are preferably made from metal or metal alloy, such as stainless steel and the like.

Each piston gland 32 and 38 has a cylindrical construction and is disposed axially within the respective first and second diameter sections 30 and 36 of the housing passageway 24. The piston glands 32 and 38 each have an outside diameter that is both slightly smaller than the respective first and second diameter sections 30 and 36 to permit slidable placement therein, and that is slightly larger than the reduced diameter sections 34 of the passageway 24 to limit axial displacement into reduced diameter section of the passageway. The piston glands each have an axial length that is similar to the length of the respective first and second diameter sections of the housing passageway so that open ends 74 of each piston gland are coterminous with the respective housing first and second open ends 26 and 28.

Figure 2:
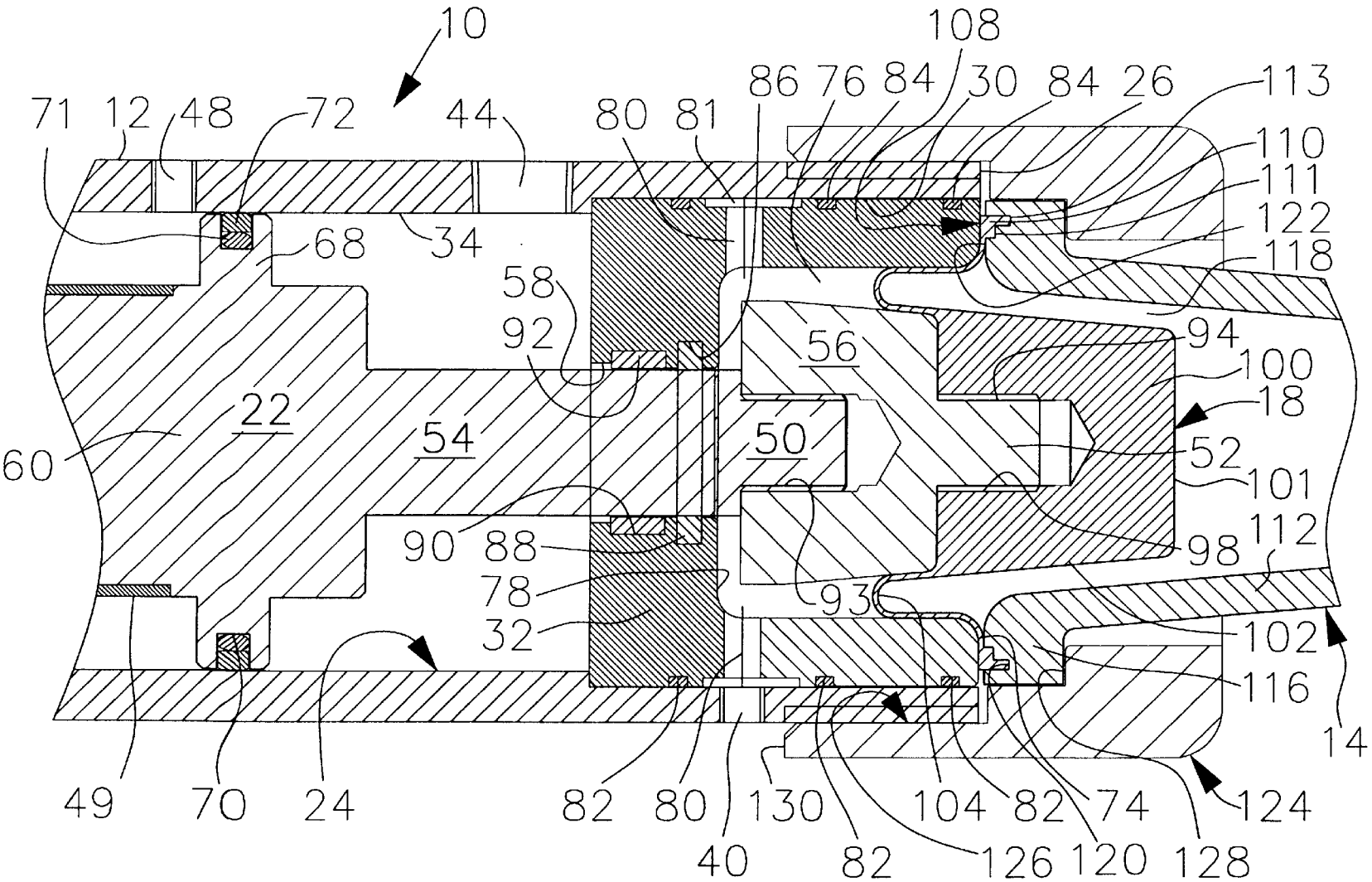
FIG. 2 is an enlarged cross-sectional side elevational view of the reciprocating pump of FIG. 1.

Referring to FIG. 2, which is only the right hand side of the pump 10, in addition to FIG. 1, the piston glands each include an annular plug chamber 76 that extends axially within each gland from its open end 74 to a gland shoulder 78 that encloses each gland opening 58. The plug chamber 76 is cylindrical in shape and is sized to accommodate placement of a respective pressurizing member plug 56 and 57 therein. Each plug chamber 76 includes one or more leak ports 80 that extends through a respective gland wall. A leak channel 81 is disposed circumferentially around the outside surface of each gland and is in communication with each leak port 80. The leak channel of each gland is sized and positioned to communicate with respective leak ports 40 and 42 that extend through the housing wall to permit fluid passage from each respective plug chamber 78 through the housing. The outside wall surface of each piston gland 32 and 38 includes a number of grooves 82 that each extend circumferentially therearound, and that are each configured to accommodate a ring-shaped seal 84 therein for providing a liquid- and air-tight seal between the housing passage 24 and each piston gland 32 and 38. The seals 84 are each preferably formed from a chemically resistant elastomeric material such as Viton, Kalrez and the like. In a preferred embodiment, the seals are in the shape of an O-ring formed from Viton. Alternatively, each piston gland seal can be provided by a dual seal arrangement, like that previously described for the piston sealing flange 68.

In a preferred embodiment, each piston gland comprises three grooves 82 and respective ring-shaped seals 84. A first circumferential groove is positioned adjacent each gland open end 74, a second groove is positioned adjacent one side of the leak channel 81, and a third groove is positioned adjacent an opposite side of the leak channel 81. Arranging the grooves 82 and seals 84 in this manner, at each axial end of the leak channel in each gland, is designed to contain any leaking process fluid to the housing first and second diameter sections and direct it from the leak channel 81 to the leak ports 40 and 42, and thereby prevent its migration to other parts of the housing.

Referring particularly to FIG. 2, the gland opening 58 through the gland shoulder 78 of each piston gland 32 and 38 preferably comprises a seal groove 86 disposed circumferentially therearound adjacent the plug chamber 76, with a piston seal 88 disposed therein. A bushing channel 90 is further disposed circumferentially around each opening 58 adjacent the seal groove 86, and a piston bushing 92 is disposed therein. Each piston seal 88 is formed from the same material described above for forming the gland seals 84. The piston bushing 92 can be formed from well know bearing materials, such as elastomeric materials that have been impregnated with friction and wear reducing agents. In a preferred embodiment, each piston bushing 92 is formed from filled PTFE.

The seal groove 86 and piston seal 88 are designed to provide a liquid- and air-tight seal between each piston gland 32 and 38 and each respective piston second and third diameter section 54 and 62 within the piston glands. Each piston bushing 92 is designed to minimize radial movement of each respective second and third piston diameter section 54 and 62 within the piston glands, thereby optimizing accurate piston centering and eliminating potential piston binding within the housing passage.

The actuating piston 22 is disposed within the housing passage 24 between the first and second piston glands 32 and 38, so that the piston second and third diameter sections 54 and 62 extend through respective gland openings 58, and so that the piston first and fourth diameter sections 50 and 64 extend into respective plug chambers 76. Each piston first and forth diameter section 50 and 64 is attached to respective pressurizing member plugs 56 and 57. The plugs can be formed from the same materials previously described above for the piston and have a cylindrical configuration with a diameter less than that of the respective plug chamber to facilitate placement therein.

To accommodate attachment with the piston, each plug 56 and 57 includes a threaded female connection 93 at one end. Each plug has a threaded male connection 94 at an opposite end to facilitate attachment with respective pressurizing members 18 and 20. As will be described in greater detail below, the plugs are designed to support side wall portions of the pressurizing member during reciprocating movement.

Referring again to FIG. 1, in addition to FIG. 2, pressurizing members 18 and 20 are in the form of rolling diaphragms and each have a generally cylindrical configuration and are formed from chemically inert non-metallic materials, such as those previously described for the piston 22. In a preferred embodiment, the pressurizing members are a one-piece construction formed from a solid billet of PTFE. Each pressurizing member includes a threaded female connection 98 to accommodate attachment with the threaded male connection 94 of a respective plug. Each pressurizing member has a substantially solid nose portion 100, opposite the female connection 98, that extends a distance from a tip 101 of the nose to about one-half of the axial length.

Configuring each pressurizing member as a one-piece construction, comprising the solid nose portion and a bore formed at one end of the member for attachment to a respective plug, eliminates having to form a hole through the member to facilitate attachment with the piston, thereby avoiding the creation of a possible leak path and source of pump failure.

In a preferred embodiment, the nose portion 100 has a tapered outside surface 102 of increasing diameter moving axially away from its tip 101. If desired, the nose portion can be configured differently, e.g., having a constant diameter outside surface. A tapered outside surface is preferred, when used with a similarly tapered pressurizing chamber, to maximize the flow velocity effect of process fluid pressurized in each pressurizing chamber 118 by the pressurizing member.

Each pressurizing member 18 and 20 includes a thin-walled skirt 104 that extends away from the nose portion. In a preferred embodiment, the skirt 104 has an outside surface of increasing diameter that complements the taper of the nose portion. The skirt is of a thin-wall construction to allow it to flex and roll upon itself during reciprocating movement of the pressurizing member nose portion 100. The skirt has an inside and outside surface. When the pressurizing member is being retracted into a respective plug chamber, i.e., when the pressurizing member is being displaced in an intake stroke, the skirt inside surface is disposed against an adjacent gland wall surface . When the pressurizing member is being expelled from the plug chamber, i.e., when the pressurizing member is being displaced in an output stroke, the skirt inside surface rolls from the piston gland surface to and adjacent plug surface. To facilitate such rolling action, it is desired that the skirt 104 have a wall thickness in the range of from about 0.01 to 1 millimeter. It is to be understood that the wall thickness of the skirt can vary depending on the particular pump application and process fluid parameters. For example, in high-temperature conditions above about 40° C., it may be desired to use a pressurizing member having a skirt wall that is thicker than that used in low-temperature conditions to help avoid unwanted temperature induced softening and/or deformation.

The skirt axial length must be sufficient to accommodate a desired amount of pressurizing member axial displacement within the pump. In an example embodiment, the skirt has an axial length that is greater than the desired pressurizing member axial travel distance and that constitutes at least ½ of the pressurizing member total axial length.

As is best shown in FIG. 2, each skirt 104 includes a flange 108 that extends radially outwardly away from a circumferential edge of the skirt. The flange 108 has an outside diameter sized approximately the same as an outside diameter of a respective piston gland 32 and 38. A tongue 110 extends axially away from the flange 108 in a direction pointed toward the chamber head, and is designed to provide an air- and liquid-tight seal with the chamber head. In a preferred embodiment, the tongue 110 has a two-step configuration comprising, moving radially outwardly, a first relatively short stepped portion 111, and a second relatively taller stepped portion 113.

The flange 108 of each pressurizing member 18 and 20 is interposed between the open ends 74 of respective piston glands 32 and 38 and chamber heads 14 and 16. As is shown in FIG. 1, each chamber head 14 and 16 is configured having a frusto conical 112 that extends axially from a nose portion 114 at one end of the body to a flange 116 at an opposite end of the body. The flange 116 extends radially outwardly away from the body and defines the body peripheral edge. The body 112 includes a pressurizing chamber 118 that extends between the nose portion and the flange 116. In a preferred embodiment, the body has a tapered shape of increasing diameter, moving from the nose portion to the flange, that complements the taper of the pressurizing member. Each chamber head 14 and 16 is formed from chemically inert non-metallic materials such as those previously described above for use in forming the pressurizing members. In a preferred embodiment, each chamber head is formed from PTFE.

Referring to FIG. 2, the Flange 116 includes a groove 120 that extends circumferentially therearound along the inwardly facing a radial edge 122 of the flange. The groove is configured to accommodate the pressurizing member tongue 110 therein. In a preferred embodiment, the groove 120 is stepped to accommodate placement of the first and second stepped tongue portions therein to provide an air- and liquid-tight seal therebetween.

Each chamber head 14 and 16 is attached to the housing 12 after: (1) each pressurizing member plug 56 and 57 has been attached to a respective pressurizing member 18 and 20 at one end; (2) each pressurizing plug 56 and 57 has been attached to a respective piston first and forth diameter section 50 and 64 at an opposite end; and after (3) each pressurizing member tongue 110 has been inserted into each chamber head groove 120 by placing the chamber head flange 116 adjacent a respective housing first and second open end 26 and 28. Use of a static tongue and groove seal between each pressurizing member and respective chamber head for forming a seal therebetween is advantageous because it avoids a the use of a dynamic sealing mechanism and, thereby avoids both the potential for process fluid contamination by generation of particulate matter from worn seals, and eliminates a possible process fluid leak path.

Each chamber head can be secured to the housing by conventional means, such as by threaded attachment therebetween or by use of external flanges and bolt connection. In a preferred embodiment, a coupling nut 124 is used to secure each chamber head to the housing. The coupling nut 124 includes an annular passageway 126 that extends therethrough from a shouldered end 128 to an opposite open end 130. The coupling nut can be made from the same materials described above for the housing. In a preferred embodiment, for low-temperature operation below about 40° C. the coupling nut is made from polypropylene, and for high-temperature operation above about 40° C. the coupling nut is made from stainless steel.

The passageway 126 adjacent the open end 130 is threaded to complement threads disposed around the outer surface of the housing 12 adjacent the respective first and second open ends 26 and 28. Tightening the coupling nut 124 to each respective housing open end traps each respective chamber head flange 116 between the housing and an inside surface of the shouldered end 128 of the coupling nut.

Referring to FIG. 1, each chamber head 14 and 16 includes means 132 for receiving fluid therein and means 134 for dispensing fluid therefrom. The means for receiving and dispensing fluid can be in the form of separate inlet and outlet ports disposed adjacent the nose portion 114 of each chamber head body. In such an embodiment, it is desired to place a check valve 135 in each inlet and outlet flow path outside of the chamber head, to prevent undesired reverse flow of fluid through each port. In a preferred embodiment, each chamber head has a single fluid port 136 disposed through the nose portion 114. The single fluid port 136 is designed to accommodate sequential fluid intake into and fluid dispensement from the chamber head during reciprocating movement of the pressurizing member. Alternatively, each chamber head may have separate inlet and outlet ports disposed through the nose portion, rather than a single fluid port.

A fluid manifold 138 is in fluid flow communication with the fluid port 136 and is disposed outside of each respective chamber head. In a preferred embodiment. the fluid manifold 138 is an integral member of the chamber head and includes the fluid inlet port 132 and a separate fluid outlet port 134. Check valves 135 are positioned in the fluid flow path of both the fluid inlet and outlet ports 132 and 134 to ensure that fluid both enters the manifold 138 via only the fluid inlet port 132, and that fluid exits the manifold via only the fluid outlet port 134. Check valves suitable for use in such application include those compatible with use in such process fluid system, such as flapper-type check valves that include no metal parts and that are formed from chemically inert materials.

Each manifold 138 can additionally include an isolation valve 144 that is positioned adjacent the chamber housing fluid port 136 to prevent fluid from entering or exiting the chamber head when actuated. The isolation valve 144 can be actuated by conventional means, such as by electrical, hydraulic, or pneumatic means, and can be configured to provide fail open or fail close service. In a preferred embodiment, the manifold 138 comprises an isolation valve 144 that is disposed both between the fluid inlet and outlet ports 132 and 134, and opposite from the chamber housing fluid port 136. The isolation valve 144 can be of conventional design, formed from non-metallic chemically inert materials, is pneumatically actuated, and is designed to fail in the closed position. As will be disclosed in greater detail below, the isolation valve is intended to be used to isolate the chamber head from the process fluid in the event that fluid leakage within the chamber head is detected.

The pump 10 is pneumatically operated by injecting pressurized air into one housing air inlet 44 or 46 while simultaneously venting air from the other housing air inlet. Referring still to FIG. 1, pressurized air that is injected into air inlet 46 and into the housing passage reduced diameter section 34, imposes a pressure force between the second piston gland 38 and the actuating piston 22, causing the piston to be slidably displaced within the housing to the right. The rightward movement of the piston 22 both causes pressurizing member 20 to be retracted away from respective chamber head 16, and causes pressurizing member 18 to be inserted into respective chamber head 14. The retraction of pressurizing member 20 causes fluid to be drawn into the chamber head 16 via respective chamber housing fluid port 136 and fluid inlet port 132. The insertion of pressurizing member 18 causes fluid to be pressurized and dispensed from the chamber head 14 through respective chamber fluid port 136 and outlet port 134.

After air has been injected into air inlet 46, and vented from the other air inlet, the input of injected air is terminated and rightward travel of the piston 22 is terminated. The injection of pressurized air into the air inlet is terminated once the desired piston travel within the housing is sensed by operation of a sensor within the piston indicator port 48. After air injection in one air inlet is terminated, air is injected into the other air inlet until the desired piston travel is again detected. Pressurized air is sequentially injected through each air inlet, causing the piston to reciprocate back and forth within the housing, and causing pressurizing members 18 and 20 to sequentially produce a pressurized fluid output. The pump is designed to be actuated by using an air supply pressure in the range of from about 30 to 150 psig.

It is desired that the pump be designed so that the amount of pressurized air needed to move the piston in each direction be less than the desired amount of discharge pressure to be produced by each pressurizing member, i.e., it is desired that the ratio of discharge pressure to actuation pressure be positive. In a preferred embodiment, the desired positive ratio is achieved by sizing the portion of the piston in contact with the pressurized air to have a larger surface area than that of the pressurizing member.

The pump can be used in conjunction with a leak detection system or device to monitor whether process fluid has migrated past the pressurizing member due to pressurizing member failure. In an example embodiment, the leak detection system may comprise sensors that are adapted to attach to leak ports 40 and 42 through the housing, and that are capable of relaying an appropriate sensor signal to a controller. Alternatively, the tubing may be routed from the leak ports to a central leak detection device to facilitate transmission of the leaking liquid to the device where it can be detected. As discussed in greater detail below, in a preferred embodiment the leak detection system is used in conjunction with a pump system to monitor the operation of the system.

A cycle sensor or the like can be connected to the piston indicator port 48 to provide a means of monitoring the cycles of the actuating piston 22. As discussed in more detail below, such cycle sensor is used in conjunction with a controller to track the performance of each pump used in a pump system.

Pumps constructed according to principles of this invention can be operated with fluids at a low temperature, e.g., below about 40° C., or with high-temperature fluids, e.g., above about 40° C. and to a maximum temperature of about 200° C. As mentioned above, the primary difference between low- and high-temperature embodiments of the pump is the materials of construction that are used for the housing and the coupling nuts. The pump capacity depends on the size of each chamber head and the cycle speed of the piston and can vary depending on the particular pump application. In a preferred embodiment, the pump has a capacity of approximately 10 to 80 liters per minute. The pump discharge pressure can be adjusted depending on the process fluid temperature, and may be as high 130 psig. It is to be understood that, to account for softening of the pressurizing members, it may be desired that the discharge pressure of the pump be decreased as the process fluid temperature increases to prevent damage to the pressurizing members. The output pressure of the pump is adjusted by reducing or increasing the pressure of the air injected in to the air inlets. It is also desired that the wall thickness of the pressurizing member skirt be increased where elevated discharge pressures are desired in high-temperature applications.

Figure 3:
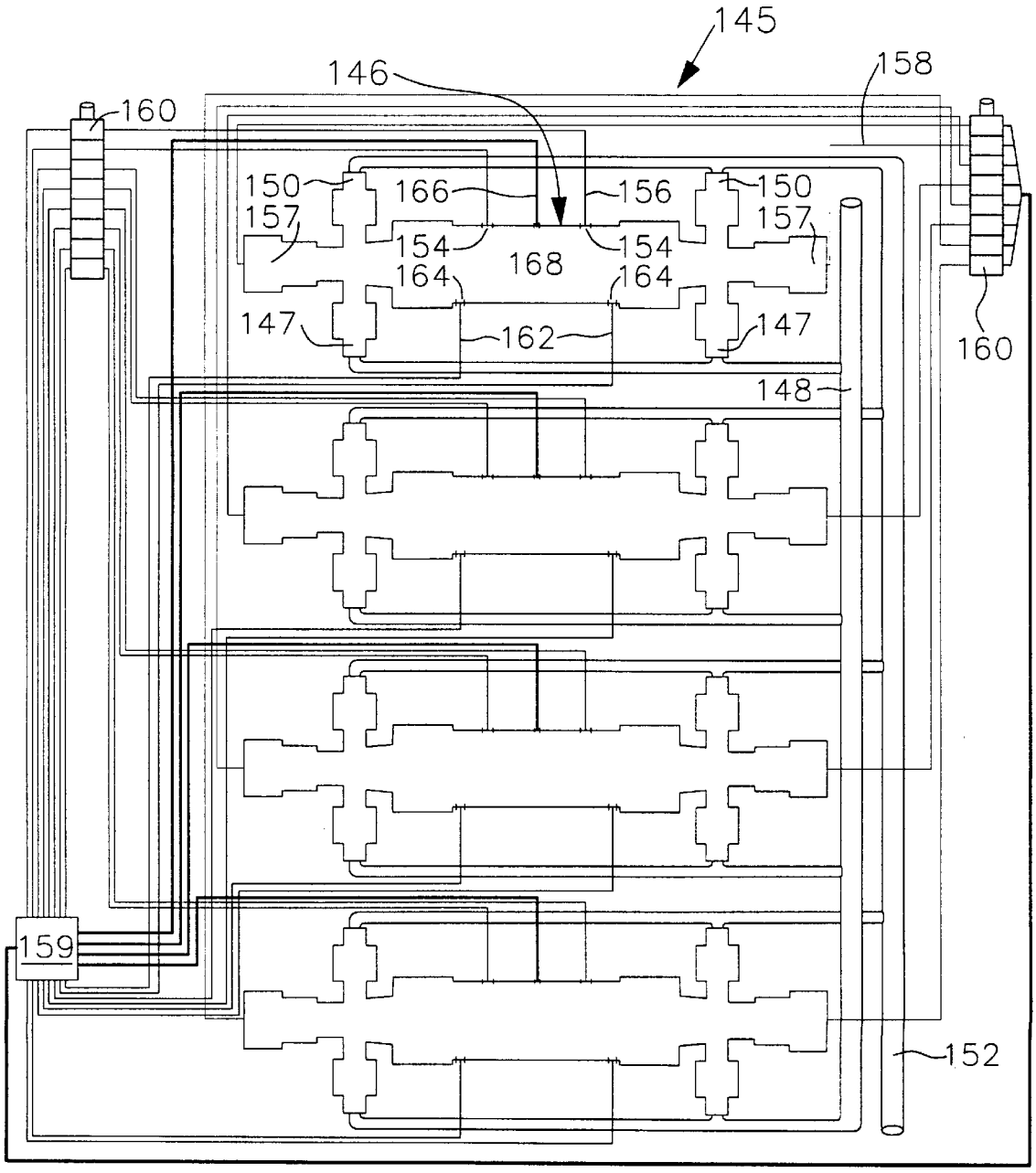
FIG. 3 is a schematic view of a pump system constructed according to principles of this invention comprising a controller and a number of reciprocating pumps illustrated in FIGS. 1 and 2.

A pump system, constructed according to principles of this invention, comprises a number of the pumps previously described above. For purposes of describing the pump system each pump will be referred to hereafter as a module, each module comprising two horizontally opposed pressurizing members. Referring to FIG. 3, a preferred embodiment of a pump system 145 includes four modules 146, comprising a total of eight pressurizing members. The fluid inlets 147 of each module are connected to a fluid inlet manifold 148 that is connected to a process fluid source. The fluid outlets 150 of each module are connected to a fluid outlet manifold 152 that is connected to a desired process fluid handling device.

Pressurized air is routed to the air inlets 154 of each module via air tubing 156 and the like. Pressurized air is also routed to the isolation valves 157 of each module via air tubing 158 and the like. It is desired that the modules of the pump system be actuated in a manner that produces a relatively constant pulseless fluid discharge pressure to avoid problems with downstream fluid handling devices, e.g., to avoid filter pulsation and the generation of resulting filter particulates. A controller 159 is configured to regulate the actuation of each module to provide a relatively constant discharge pressure by controlling the sequence of routing pressurized air to each module. For example, in a four module system where each module is configured to provide one cycle per second, it is desired that the controller 159 be programmed to provide pressurized air to each module air inlet 154 in one-eighth second sequencing.

In an exemplary embodiment, the controller is additionally configured to produce electric signals that actuate solenoids 160, which solenoids operate to regulate the supply of pressurized air supply to the air inlets 154 of the modules, and operate to provide pressurized air to the isolation values 157. It is to be understood that this is but one embodiment of how the pump system can be configured and operated to provide a relatively constant fluid discharge pressure, and that other embodiments are intended to be within the scope of this invention. For example, instead of four modules the pump system can comprise any number of modules that is capable of being actuated to provide a relative flat discharge pressure. Additionally, rather than using separate solenoids, the controller can be configured to having internal means for dispensing pressurized air to the air inlets 154 and isolation valves 157.

Referring still to FIG. 3, the pump system comprises a number of leak detection sensors 162 that are connected to the leak ports 164 of each module. The leak detection sensors 162 are connected to the controller 159 and are adapted to provide an indication of whether process fluid has migrated past a pressurizing member within the modules. Upon detecting any such leakage in a particular module, the controller is configured to both discontinue routing pressurized air to the module air inlets 154, and to discontinue routing pressurized air to the module isolation valves 157. Configured in this manner, the controller both terminates operation of a leaking module and isolates the leaking module from fluid inlet or outlet flow, thereby both preventing the possible introduction of contaminates from the leaking module into the process fluid, and allowing the module to be serviced.

In a preferred embodiment, the controller 159 is also configured to compensate for a nonoperating or isolated module by resequencing the operation of the remaining modules to provide the most constant discharge pressure, thereby making the pump system fault tolerant. A fault tolerant pump system is desired as it allows the pump system to continuously operate while the isolated module is being serviced, thereby avoiding costly downtime associated with taking the entire pump system offline.

In a preferred embodiment, the controller is also configured to monitor the number of cycles that each module has been operated by use of a cycle sensor 166 connected to each module piston indicator port 168 so that a performance history for each module in the pump system can be maintained and downloaded for evaluation of performance history. The controller 159 can also be configured to monitor the temperature of the process fluid and the discharge pressure from the pump system, or from each module, and regulate the operation of the modules to correspond to a desired temperature and pressure curve, thereby preventing the modules from exceeding a desired maximum discharge pressure at a given pressure. Configuring the controller in this manner is desired to extend the service life of the pump system.

A feature of the pump constructed according to principles of this invention is that the wetted area of the pump are formed entirely from a chemically inert non-metallic material, such as PTFE, thereby eliminating the possibility of process fluid contamination that may occur from deteriorating or corroding materials.

Another feature of the pump is the design of the pressurizing member in the form of a rolling diaphragm, whereby the pressurizing member is permitted to move in a reciprocating manner within a respective chamber head by the rolling action or rolling transfer of the thinwalled skirt between the piston gland and respective pressurizing member plug. The use of such rolling diaphragm minimizes the possibility of pressurizing member failure due to overstressed and/or unsupported flexible portions.

Still other features of the pump are that the wetted area has only one leak path, which is across the tongue and groove seal between the pressurizing member and the chamber head. The design of the pump having a single leak path is possible due to the use of a static pressurizing member seal and because the pressurizing member is formed from a solid imperforate billet of PTFE, thereby avoiding the need to place a hole therethrough to facilitate attachment with the piston.

Figure 4:
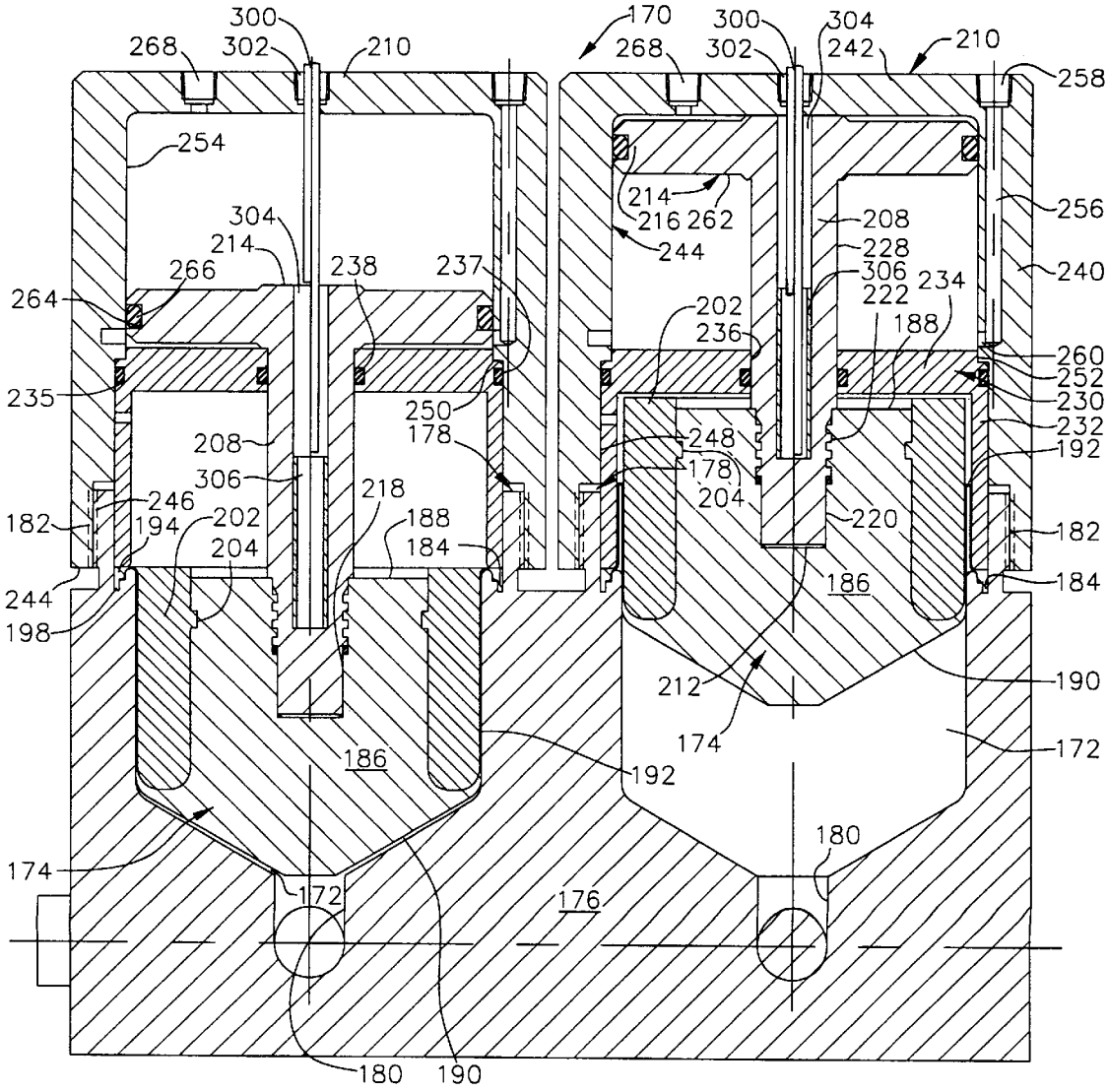
FIG. 4 is a cross-sectional side elevational view of a vertical pump constructed according to principles of this invention.

FIG. 4 illustrates another pump embodiment 170 comprising one or more vertically arranged pressurizing chambers 172 and respective unconnected pressurizing members 174. Such pump embodiment is designed for use in applications such as slurry transport, wherein the slurry comprises abrasive particulate material for use in semiconductor manufacturing processes, e.g., during chemical mechanical planarization. The pump 170 comprises a pump housing 176 having one or more pressurizing chamber 172 disposed therein. The pump housing is formed from the same types of fluoropolymer materials described above for forming wetted members of the earlier described pump, e.g., the chamber heads 14 and 16 in FIG. 1. In a preferred embodiment, the pump housing is formed from PTFE or PFA. In an exemplary embodiment, the pump housing 176 has a generally rectangular configuration that comprises a pair of pressurizing chambers 172 disposed adjacent one another. The pump housing 176 can have the pressurizing chamber 172 formed by molding or by machining process, depending on economics. In an exemplary embodiment, the pressurizing chamber 172 is formed within the housing by machining.

Each pressurizing chamber 172 is circular in cross section and extends a depth downwardly into the pump housing from a housing open end 178. The bottom section of each pressurizing chamber is tapered radially inwardly and converges into an axially downwardly directed fluid passageway 180 at a base section or substantially closed end of the pressurizing chamber. The bottom section is tapered inwardly to act as a funnel to direct the particulate material in the slurry to and into the fluid passageway so that it does not accumulate in the pressurizing chamber, where it could abrade or otherwise interfere with the efficient movement of the pressurizing member therein. The fluid passageway 180 is also formed by machine or mold method and is used to facilitate fluid passage to and from each respective pressurizing chamber 172. As better described below and illustrated in FIGS. 5 and 6, each fluid passageway 180 is in hydraulic communication with inlet and outlet checkvalve modules 270 and 272 to control fluid inlet and outlet from each respective pressurizing chamber.

Figure 7:
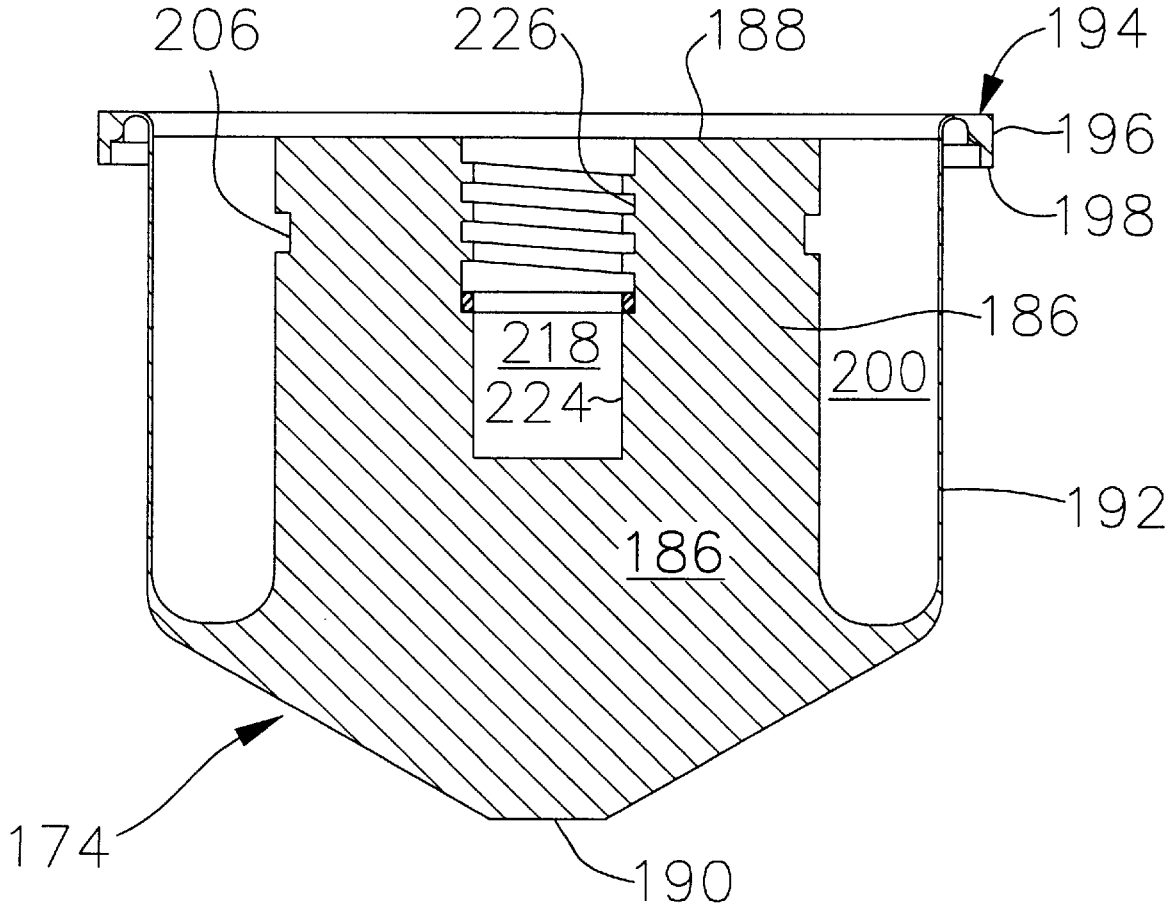
FIG. 7 is a cross-sectional side elevational view of a pressurizing member taken from the pump of FIGS. 4 to 6.

The pump housing open end 178 includes a threaded outside wall surface 182 that extends circumferentially around the top of each pressurizing chamber 172. A groove 184 extends circumferentially around each pressurizing chamber 172 along respective housing inside wall surfaces. The pressurizing members 174 are each disposed within a respective pressurizing chamber 172, and are each formed from a solid billet of fluoropolymer material selected from the same materials described above for the pressurizing members 18 and 20 illustrated in FIG. 1. In a preferred embodiment, the pressurizing members 174 are machined from a solid billet of PTFE. Referring to FIGS. 4 and 7, each pressurizing member 174 has a circular cross-sectional profile and includes a centralized body 186 that extends axially from a first body end 188, adapted for connection to a piston shaft, to an oppositely oriented second body end 190, that is adapted to fit within the tapered portion of the respective pressurizing chamber. A thin-walled skirt 192 is integral with and extends radially outwardly from the second body end 190 a desired distance. The skirt 192 extends axially along a constant diameter section of the body 186 that is of constant diameter towards the first body end 188. The skirt 192 has a thin-wall construction of sufficient thickness and axial length to permit it to flex and roll along itself in response to axial movement of the pressurizing member, as described better below. The preferred skirt wall thickness is the same as described above.

Adjacent the first body end 188, the thin-walled skirt 192 includes a flange 194 that projects radially outwardly therefrom and that defines a terminal circumferential edge. The flange includes a outwardly directed surface 196 that extends circumferentially therearound, and that is sized and shaped to fit snugly within the inside wall surface of a respective housing open end 178. The flange also includes a downwardly directed tongue 198 that extends circumferentially therearound and that is sized and shaped as described above to fit snugly within the respective pump housing groove 184 when the pressurizing member 174 is disposed within a respective pressurizing chamber 172 to provided a leak-tight seal therebetween.

An annular channel 200 is formed between the pressurizing member body 186 and skirt 192 and extends axially along the constant diameter section of the body. An annular pressurizing member plug 202 is disposed within the annular channel 200, extends axially along the entire length of the channel, and has an inside and outside diameter that is sized to fit snugly within the channel 200. The plug 202 is formed from the same materials and is designed to perform in the same manner as discussed above. The plug includes means for attaching to the body 186 so that it is retained snugly within the annular channel 200 to move axially with the pressurizing member 174. In an exemplary embodiment, the plug 202 includes a ridge 204 that projects radially a distance away from an inside wall surface that is sized and shaped to fit within a groove 206 disposed within a body wall surface. In an exemplary embodiment, the plug is molded from polypropylene and is sized having an inside diameter less than that of the body 186. Each plug 202 is installed into a respective annular channel by cooling the pressurizing member, to cause it to contract in size, and heating the plug, to cause it to expand in size, prior to assembly.

An actuating piston 208 is disposed above a respective pressurizing member 174 and is axially movable within a respective piston housing 210, that will be better described below. Such pistons are formed from the same materials described above for the piston of the first pump embodiment. In an exemplary embodiment, the pistons are formed from polypropylene. A feature that distinguishes the pump embodiment illustrated in FIGS. 4 to 7 from that previously described is that the actuating pistons 208 for each pressurizing member are independent, i.e., are not placed into reciprocating operation by a common shaft connecting one another. Rather, each actuating piston is separately actuated, and each piston output and intake stroke speed controlled, to provide a substantially constant output pressure. Configuring the pump in this manner permits more operational flexibility and enables controlled output pressures using a single dual-piston pump without having to use or configure a pump system using more than one such pumps.

Each piston 208 has a T-shaped cross-section profile having a first piston end 212, adapted to attach to a respective pressurizing member first body end 188, and an oppositely oriented second piston end 214 having a radially outwardly projecting flange 216 that is adapted for axial displacement within the respective pump housing 210. The piston first end 212 is sized and shaped to fit within and attach to a piston opening 218 located centrally along the pressurizing member first body end 188, and that extends axially therefrom a desired depth. In an exemplary embodiment, the piston first end 212 includes a non-threaded section 220 that extends axially a distance to a threaded section 222 that extends axially a distance along the piston from the non-threaded section 220. The non-threaded and threaded piston sections are configured to fit within complementary nonthreaded and threaded sections 224 and 226 of the pressurizing member 174.

Moving axially away from the first piston end threaded section 222, each piston includes an enlarged diameter section 228, i.e., a section having a diameter greater than the threaded and non-threaded piston sections. The piston abuts against the first end 188 of a respective pressurizing member 174 at the transition point between the threaded piston section and enlarged diameter section, serving to control the insertion depth of the piston therein. The piston enlarged diameter section 228 extends axially away from a respective pressurizing member 174 and into the piston housing 210.

A piston gland 230 is disposed within a respective piston housing 210 and extends axially above a respective pressurizing chamber 172 and pressurizing member 174 assembly. Each piston gland 230 has a generally circular cross-sectional profile and comprises an annular cylindrical wall 232 that is positioned concentrically within the piston housing 210. The gland cylindrical wall 232 extends axially downwardly away from a disk-shaped platform 234 that extends radially across the pump housing diameter. The gland wall 232 has an outside diameter that is sized to fit snugly within an inside surface of the pump housing open end 178, and has a terminal downwardly-facing edge that is shaped to abut against a respective pressurizing member skirt flange 194 to force the flange tongue 198 into the respective pump housing groove 184. The gland wall 232 has an inside diameter that is sized to enable axial displacement of a respective piston plug 202 and piston skirt 192 therein when the pressurizing member is being axially retracted from its respective pressurizing chamber (as shown in FIG. 4 on the right-hand side pressurizing chamber). Such retracting movement is enabled by the rolling transfer of the skirt from the plug surface to the adjacent gland surface.

Each piston gland platform 234 includes a centrally located piston shaft opening 236 extending axially therethrough to accommodate placement of the piston enlarged diameter section 228 therein. A piston shaft seal 238, such as that previously disclosed, is disposed within the piston shaft opening 236 to provide an air-tight seal therebetween. Each piston gland cylindrical wall 232 includes a groove 235 that extends circumferentially around an outside surface facing the piston housing. The groove is located a distance below the gland platform 234 and is designed to accommodate a seal 237, e.g., and O-ring seal, therein to provide an air-tight seal between the adjacent piston gland and piston housing surfaces. As discussed below, the use of seals within each gland piston opening 236 and wall 232 is needed to prevent air from leaking out of the piston housing from the piston gland platform, as such air is used to actuate the piston.

Each piston housing 210 comprises a cylindrical wall 240 that extends axially downwardly from a housing closed end 242 and that defines a piston chamber 244 therein for accommodating a respective piston 214 and piston gland 230. The housing wall 240 has an open terminal end 244 that is threaded along an inside surface 246 to engage and attach with the pump housing threaded outside surface 182. Moving axially upwardly away from the threaded inside surface 246, the piston chamber 244 includes a reduced diameter section 248 that extends axially to a shoulder 250 that projects radially inwardly into the chamber a distance. The inside diameter of the piston chamber reduced diameter section 248 is the same as the pump housing first end 178 inside surface to accommodate placement of a respective piston gland 230 therein. The housing chamber shoulder 250 is located and sized to fit within a complementary shoulder groove 252 extending circumferentially around an outside edge of a respective piston gland platform 234. When the piston housing 210 is securely tightened to the pump housing 176, the housing chamber shoulder 250 serves to trap the piston gland therebetween and force the piston gland wall 232 downwardly onto the pressurizing member skirt flange 194 to perfect the tongue and groove seal.

Moving axially upwardly away from the shoulder 250, the piston chamber 244 includes an air actuator section 254 that has a constant diameter sized to accommodate placement and axial displacement of a respective piston flange 216 therein. A section of the piston housing wall that extends axially along the air actuator section 254 includes a first air port 256 disposed therein that axially downwardly extends from an air inlet 258, positioned at the piston housing closed end 242, to an fair outlet 260 that is in the form of a groove disposed circumferentially along the base of the piston chamber air actuator section 254 adjacent the shoulder 250. The first air port 256 is used to transport air at a desired actuating pressure to the base of the air actuator section and onto a frontside surface 262 of a respective piston flange 216. Each piston flange 216 includes a groove 264 running circumferentially around a radially directed flange edge, and a seal 266 disposed therein to provide an air-tight seal between the piston flange and adjacent piston chamber air actuator section wall surface. Thus, air being transported to the air actuator section 254 via the first air port 256 is used to actuate the piston axially away from the piston gland, and the pressurizing member away from the pressurizing chamber, i.e., is used to perform a pump intake stroke (as shown in FIG. 4 in the right-hand side pressurizing chamber).

The seal 266 can be in the form of an O-ring seal, made from the same types of chemically resistant elastomeric seal materials discussed above, alone or in combination with one or more relatively rigid seal members or shoes. In an exemplary embodiment, the seal 266 comprises an elastomeric seal member made from Viton, that extends radially to make sealing contact against adjacent piston and chamber wall surfaces, and upper and lower rigid seal members made from TFE, that cover portions of the elastomeric seal member's upper and lower surface to protect the elastomeric seal member from being extruded between the piston and chamber wall.

Each piston housing 210 also includes a second air port 268 that extends through the housing closed end 242 for passing air into the housing air actuator section 254 to axially displace the piston and respective pressurizing member downward towards the piston gland and pressurizing chamber, i.e., is used to perform a pump output stroke (as shown in FIG. 4 in the left-hand side pressurizing chamber). The process of cycling the pump through its intake stroke requires that the second air port 268 be vented, or otherwise exposed to air of lower pressure that of the air being forced through the first air port 256, to permit the piston to be displaced upwardly within the housing chamber with little or no resistance. Conversely, the process of cycling the pump through its output stroke requires that the first air port 256 be vented, or otherwise exposed to air of lower pressure that of the air being forced through the second air port 258, to permit the piston to be displaced downwardly within the housing chamber with little or no resistance.

Figure 5:
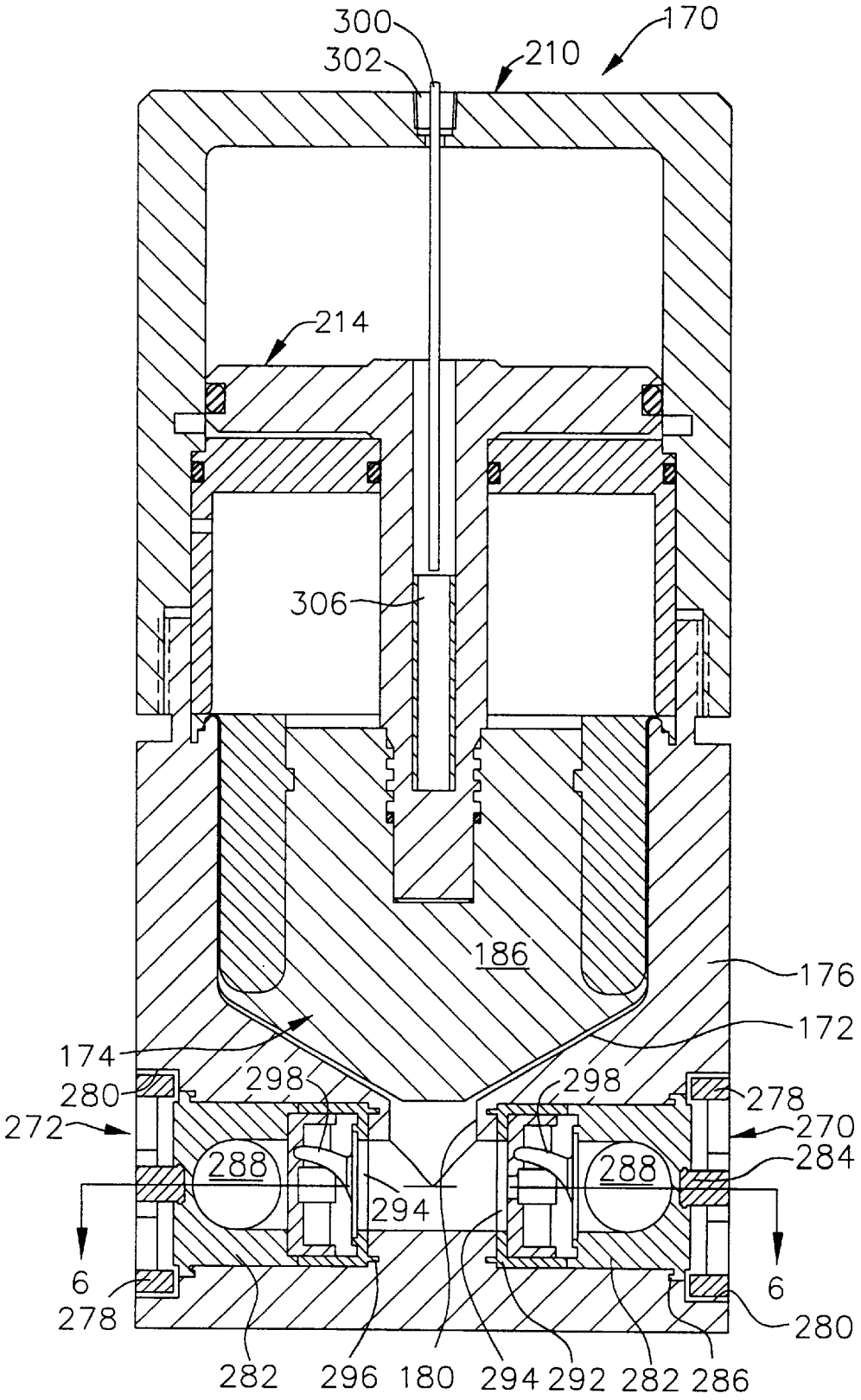
FIG. 5 is a cross-sectional front elevational view of the vertical pump of FIG. 4 across section 5—5.
Figure 6:
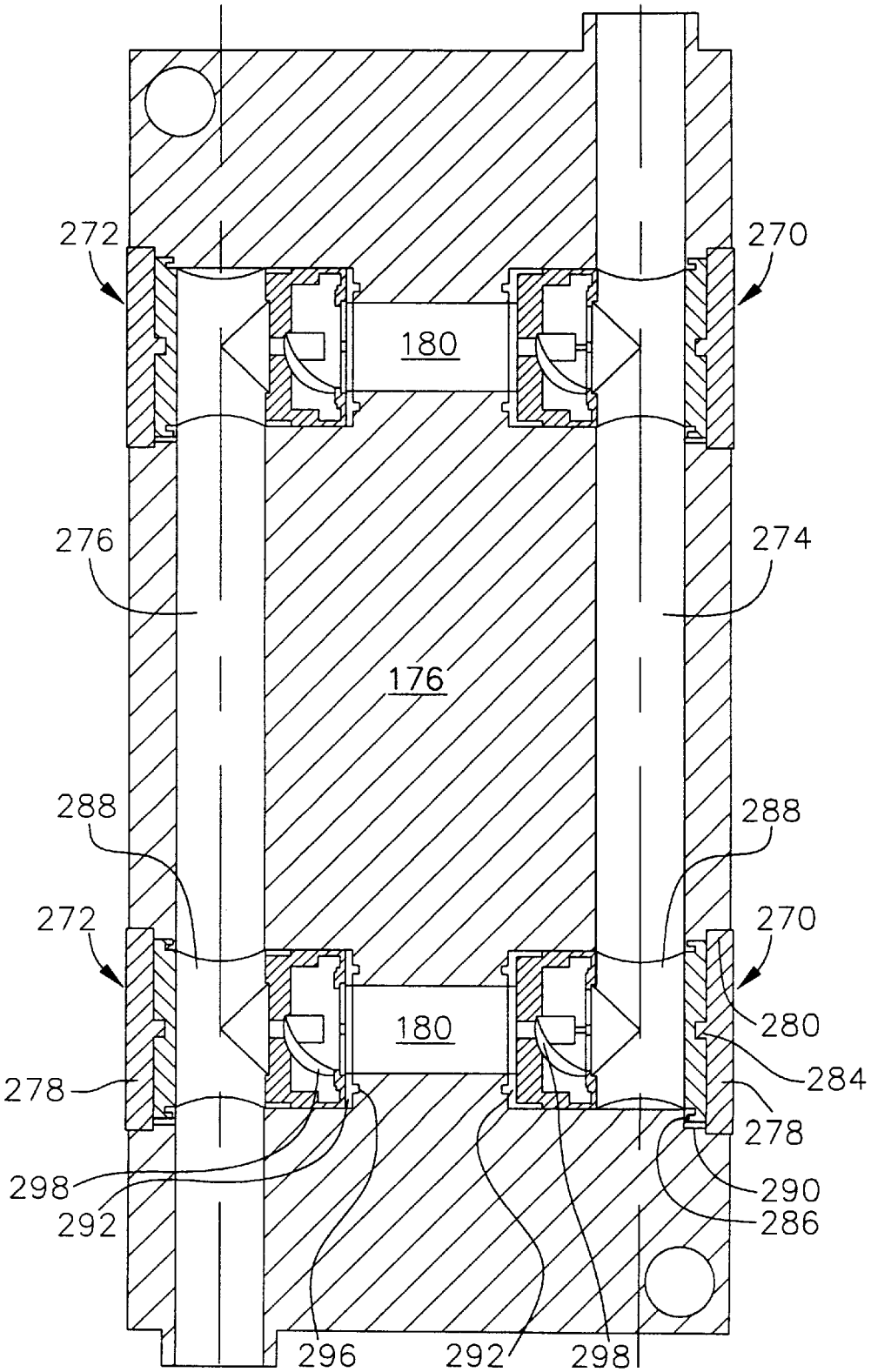
FIG. 6 is a cross-sectional plan view of the vertical pump of FIGS. 4 and 5 across section 6—6.

Referring now to FIGS. 5 and 6, the fluid passageway 180 of each pressurizing chamber 172 is in hydraulic communication with both an inlet checkvalve module 270 and an outlet checkvalve module 272 that are removably attached to a base of the pump housing 176 below each respective pressurizing chamber. As best shown in FIG. 6, an exemplary pump comprising two pressurizing chambers comprises two inlet checkvalve modules 270, one for each pressurizing chamber, that are in hydraulic communication with one another via a fluid inlet passage 274 that extends between one another and exits the pump housing 176 for connection with a suitable fluid source connector. The inlet checkvalve modules 270 function to permit the passage of fluid from the fluid inlet passage 274 to each fluid passageway 180 during a piston intake stroke within each pressurizing chamber. Under such intake conditions a sufficient differential pressure is created across each intake checkvalve module to cause a valve member disposed therein to be unseated and permit fluid flow therethrough. Such an exemplary pump also comprises two outlet checkvalve modules 272, one for each pressurizing chamber, that are in hydraulic communication with one another via a fluid outlet passage 276 that extends between one another and exits the pump housing 176 for connection with a suitable fluid outlet connector. The outlet checkvalve modules 272 function to permit the passage of fluid from the fluid passageway 180 of each pressurizing chamber to the fluid outlet passage 276 during a piston output stroke within each pressurizing chamber. Under such output conditions a sufficient differential pressure is created across each outlet checkvalve module to cause a valve member therein to be unseated and permit fluid flow therethrough.

Each inlet and outlet checkvalve module comprises a multi-component construction made up of a module cap 278 that is generally disc-shaped and that has a threaded edge surface for threaded engagement with a complementary threaded checkvalve opening 280 in the pump housing. A cylindrical module body 282 is attached to the module cap 278 by a rotatable connection to enable the module cap 278 to be rotated vis-a-vis the module body 282 without causing the module body 282 to rotate within the checkvalve opening 280. In an exemplary embodiment, the module cap 278 comprises a male connection member 284 that projects axially outwardly therefrom and that includes a flared end. The male connection member 284 is sized to snap into a complementary opening in an end of the module body to provide a rotatable attachment therewith. Each module body 282 includes a tongue 286 disposed circumferentially around a edge of the body adjacent the module cap that is sized to provide a liquid-tight seal with a complementary groove disposed around a respective pump housing checkvalve opening 280.

Each module body 282 includes a fluid flow port 288 that extends radially therethrough. Each module body 282 includes alignment or positioning means to ensure the proper positioning of each module body 282 within the pump housing 176, so that the module fluid flow port 288 is aligned with its respective fluid inlet or outlet passage 274 and 276. In an exemplary embodiment, such alignment or positioning means can be in the form of a notch or the like disposed along an edge of the module body adjacent the module cap that is positioned and sized to accept placement of a positioning pin 290 therein that projects from the pump housing checkvalve opening 280. Cooperation between the positioning pin and notch ensures that the checkvalve module can only be placed within a respective checkvalve opening in an orientation that ensures alignment of each module body fluid flow port with its respective fluid inlet or outlet passage. The module fluid flow port 288 not only passes diametrically through the body but passes axially away from the module cap 278.

Each module body 282 includes an end opposite the module cap that is adapted to attach with a module body cap 292 that is designed to fit thereover. In an exemplary embodiment, the module body end is constructed having a terminal wall portion, defining the attaching end, cut axially into four sections and configured having a flared outside surface. Together, the sectioned and flared module body end is sized to provide a snap fit within a complementary end of the body cap 292. The body cap 292 includes an opening 294 at an end opposite the module body 282 that is positioned adjacent the fluid passageway 180, which end also includes a tongue 296 extending circumferentially therearound that is sized to fit within a groove disposed within the pump housing checkvalve opening to provide a fluid-tight tongue and groove seal therebetween.

A checkvalve 298 is interposed between each module body 288 and body cap 292 and is of a one-piece construction formed from a suitable non-metallic fluoropolymeric materials. The checkvalve is designed to fit between oppositely oriented valve seats formed in the body cap opening 294 at one end and in the module body axial fluid flow port at an opposite end. As best shown in FIG. 5, the checkvalves 298 that are used for each inlet and outlet checkvalve module are the same, however, are positioned differently within each inlet and outlet checkvalve module to provide checked flow in the desired direction.

Constructed in this manner, the checkvalve modules are easily removable from the pump housing and replaceable in the event that they become problematic or fail. For example, when placed into slurry transport service it is reasonable to expect that, due to the abrasive nature of the fluid being transported, the checkvalve members will be subjected to a high degree of abrasive wear that will eventually cause them to fail before the remaining pump components. In such application, the use of such checkvalve modules makes their removal and replacement both easy, since no special training or tools are required to perform the task, and efficient, since the pump does not have to be taken off line for long periods of time.

The pump illustrated in FIGS. 4 to 7 is operated, after connecting the fluid inlet and outlet passages 274 and 276 to a suitable fluid supply source and outlet, by routing air at a determined pressure to each of the air actuation chambers 254. Specifically, the pressurizing members 174 are each displaced axially within their respective pressurizing chambers 172 at different cycles to achieve a substantially constant output pressure, e.g., while one pressurizing member is being air actuated downwardly to perform an output stroke the other pressurizing member is being air actuated upwardly to perform an input stroke (as shown in FIG. 4). To ensure a substantially constant output pressure, the air actuating pressures used to perform a pressurizing member intake and output stroke can be different. For example, the air passed through each first air port 256 can be of a higher pressure than that routed to each second air port 268 to cause each pressurizing member 174 to perform its intake stroke at a greater speed than each output stroke to ensure that the output strokes for each pressurizing member are substantially continuous. The ability to cycle the pump in such manner, having different intake and output cycle speeds, is a feature provided by the pump not having a common shaft driving the pressurizing members.

The position of each pressurizing member within a respective pressurizing chamber is determined by a sensing means 300 that can be either invasive or noninvasive. Referring to FIGS. 4 and 5, in an exemplary embodiment, the sensing means 300 is in the form of a pair of fiber optic sensors that are each disposed through a sensor opening 302 through each piston housing closed end 242. The fiber optic sensors 300 are disposed downwardly through the housing chamber 244 and into a sensor channel 304 disposed axially through each piston a depth from the piston body end 214. A colored sleeve 306, e.g., a black colored sleeve, is disposed within a base portion of the sensor channel. The fiber optic sensors 300 are positioned one above the other and are directed radially outwardly to detect the color change within the sensor channel 304 to detect the displacement of the piston and pressurizing member within the piston housing and pressurizing chamber, respectively. Together, the two vertically-stacked optical sensors are used to determine completion of piston upward displacement, i.e., completion of a pressurizing member intake stroke, and the completion of piston downward displacement, i.e., completion of a pressurizing member output stroke.

The sensing means is configure to provide a piston-locating signal to a controller or the like that regulates the placement and pressure of actuating air that is routed to the pump. The use of such sensor means in the pump is critical to being able to control each piston upward and downward stroke to ensure a pulseless, continuous pump output pressure. If desired, more than one of the pumps can be connected together to form a pump system, where actuation of each of the pressurizing members is controlled to provide a desired pump system output to meet specific application criteria.

Although limited embodiments of pumps and pump systems have been specifically described and illustrated herein, and specific dimensions have been disclosed, many modifications and variations will be apparent to those skilled in the art. Accordingly, it is to be understood that, within the scope of the appended claims, pumps and pump systems according to principles of this invention may be embodied other than as specifically described herein.

What is claimed is:

1. A pump for pressurizing process fluid comprising:

a pump housing having at least one pressurizing chamber disposed therein, wherein the pressurizing chamber comprises a substantially closed chamber end at one axial end and an open chamber end at an opposite axial end, and wherein the substantially closed chamber end is in hydraulic connection with a fluid transport passageway;

a pressurizing member disposed within the pressurizing chamber, the pressurizing member having a one-piece construction formed from a fluoropolymeric material and including:

a generally cylindrical body having a solid imperforate head at one body end that is positioned adjacent the closed chamber end;

a thin-wall skirt extending away from the body head and having an inner and outer surface; and a flange extending circumferentially around a terminal edge of the skirt;

a piston disposed axially within the pump housing and connected at one end to the pressurizing member opposite the body head;

a piston gland attached to the open pump chamber end and having an inside diameter that is complementary to that of the pressurizing chamber, wherein the piston gland includes a diametrically extending portion with a piston opening for accommodating the piston therethrough, and wherein the pressurizing member flange is interposed between the pressurizing chamber and the piston gland and includes sealing means to provide a fluid-tight seal therebetween;

a pressurizing member plug attached to the pressurizing member and extending a distance axially away from the body head towards the piston, the plug having an outside wall surface that contacts and carries a variable portion of the skirt inside surface during reciprocating pressurizing member axial displacement;

wherein the pressuring member thin-wall skirt has sufficient axial length to roll between the plug outside wall surface and the gland inside diameter to permit pressurizing member reciprocating axial displacement within the pressurizing chamber.

2. The pump as recited in claim 1 wherein when the pressurizing member is at a maximum pump intake stroke the pressurizing member thin-wall skirt outside surface is directed towards itself, and the thin-wall skirt inside surface is disposed only against the gland inside diameter and the pressurizing member plug outside surface.

3. The pump as recited in claim 1 wherein when the pressurizing member is at a maximum pump output stroke the pressurizing member thin-wall skirt outside surface is disposed entirely within the pressurizing chamber and directed towards the pressurizing chamber wall, and the thin-wall skirt inside surface is disposed only against the pressurizing member plug outside surface.

4. The pump as recited in claim 1 wherein the pump comprises a pair of horizontally arranged pressurizing chambers, pressurizing members, pistons, piston glands, and pressurizing member plugs at opposite ends of the pump housing, and wherein the pistons are joined together by a common shaft to produce joined reciprocating pressurizing member axial displacement within each respective pressurizing chamber.

5. The pump as recited in claim 1 wherein the thin-wall skirt flange comprise a tongue extending circumferentially therearound that projects a distance therefrom, and that is sized to fit within a complementary groove disposed within the pressurizing chamber open end to provide a fluid-tight seal therewith.

6. The pump as recited in claim 1 further comprising a fluid inlet port and a fluid outlet port each in hydraulic communication with the pressurizing chamber fluid passageway, wherein the fluid outlet and inlet port each include checkvalves attached thereto for controlling fluid passage through the pressurizing chamber.

7. The pump as recited in claim 6 wherein the checkvalves are of modular construction comprising:

a module top cap that is removable attached to the pump housing;

a checkvalve body that is rotatably attached to the module cap at one checkvalve body end, wherein the checkvalve body includes a fluid flow port disposed therein to facilitate fluid flow through the checkvalve body, wherein the fluid flow port includes a valve seat at one end;

a checkvalve body cap attached to the checkvalve body at an end opposite the module top cap, wherein the checkvalve body cap includes a fluid flow port and valve seat for passing fluid from the checkvalve body valve seat to the pressurizing chamber fluid passageway;

a non-metallic checkvalve interposed between the checkvalve body valve seat and checkvalve body cap valve seat and designed to permit flow in one direction through the checkvalve body; and means for positioning the checkvalve body within the pump housing to align the checkvalve body fluid flow port.

8. The pump as recited in claim 1 wherein the pump comprises a pair of vertically arranged pressurizing chambers, pressurizing members, pistons, piston glands, and pressurizing member plugs within the pump housing, and wherein the pistons are independent of one another to produce independent reciprocating pressurizing member axial displacement within each respective pressurizing chamber.

9. The pump as recited in claim 8 further comprising sensor means connected to the pump to monitor piston displacement therein to provide a pulseless pump output pressure.

10. The pump as recited in claim 1 wherein the pump housing includes a leak port that extends through a housing wall from a position external of the pressurizing chamber to facilitate detecting process fluid leakage from the pressurizing chamber.

11. A pump for pressurizing process fluid comprising:

a pump housing having a pair of pressurizing chambers disposed therein, wherein each pressurizing chamber comprises a substantially closed chamber end at one axial end and an open chamber end at an opposite axial end, and wherein the substantially closed chamber end is in hydraulic connection with a fluid transport passageway;

a pressurizing member disposed within each pressurizing chamber, wherein each pressurizing member has a one-piece construction formed from a fluoropolymeric material and includes:

a generally cylindrical body having a solid imperforate head at one body end that is positioned adjacent the closed chamber end;

a thin-wall skirt extending radially outwardly a distance away from the body and extending axially away from the body head, the skirt having a outside surface and an oppositely directed inside surface; and a flange extending circumferentially around a terminal edge of the skirt;

a pair of pistons each disposed axially within the pump housing and connected at one end to a respective pressurizing member opposite the body head;

a pair of piston glands each attached to a respective open pump chamber end and having an inside diameter that complements the respective pressurizing chamber, wherein each piston gland includes a diametrically extending portion with a piston opening for accommodating the respective piston therethrough, and wherein the pressurizing member flange is interposed between a respective pressurizing chamber and piston gland and includes sealing means to provide a fluid-tight seal therebetween;

a pair of pressurizing member plugs attached to a respective pressurizing member and extending a distance axially away from the body head towards a respective piston, each plug having an outside wall surface that contacts and carries a variable portion of the skirt inside surface during reciprocating pressurizing member axial displacement;

wherein each pressuring member thin-wall skirt has sufficient axial length to roll between the plug outside wall surface and the gland inside diameter so that during a pressurizing member maximum intake stroke the skirt outside surface is facing itself and a portion of the skirt inside surface is on the piston gland inside diameter.

12. The pump as recited in claim 11 wherein the pump pressurizing chambers, pressurizing members, pistons, piston glands, and pressurizing member plugs are horizontally arranged at opposite ends of the pump housing, and wherein the pistons are joined together by a common shaft to produce joined reciprocating pressurizing member axial displacement within each respective pressurizing chamber.

13. The pump as recited in claim 11 wherein the pump pressurizing chambers, pressurizing members, pistons, piston glands, and pressurizing member plugs are vertically arranged within the pump housing, and wherein the pistons are independent of one another to produce independent reciprocating pressurizing member axial displacement within each respective pressurizing chamber.

14. A reciprocating pump for pressurizing process fluid comprising:

a housing having an annular passageway extending therethrough between opposed open ends;

a piston slidably disposed within the housing;

a piston gland disposed at each housing end to accommodate placement of the piston therethrough to guide slidable displacement of the piston within the housing, each piston gland having seals disposed along an outside surface to form an air- and liquid-tight seal against the annular passageway;

a pressurizing member plug connected at one end to each piston end and disposed adjacent a respective piston gland;

a pressurizing chamber assembly disposed at each housing end, each pressurizing chamber assembly comprising:

a chamber head connected to a respective housing end, the chamber head including means for receiving and discharging process fluid; and a pressurizing member disposed within the chamber head having a cylindrical body that is a one-piece construction formed from a fluoropolymeric material including a solid nose portion and a hollow skirt, the pressurizing member and inside surface of a respective chamber head forming a pressurizing chamber therebetween, wherein the body is attached at one end to a respective pressurizing member plug so that a inside surface of the hollow skirt is in contact with the pressurizing member plug to provide support thereto, the hollow skirt having a flanged end that is interposed between the chamber head and the housing end to form a static fluid-tight seal therebetween; and means for actuating the piston to produce reciprocating axial displacement of the piston within the passageway;

wherein the hollow skirt extends axially a sufficient length and has a thin wall construction to roll between the piston gland and pressurizing member plug to permit reciprocating pressurizing member axial displacement within the chamber head.

15. The pump as recited in claim 14 wherein each flange and respective chamber head has a tongue and groove sealing attachment therebetween, and wherein each such static seal defines the the only fluid leak path from each pressurizing chamber.

16. A pump for pressurizing process fluid comprising:

a pump housing having at least two vertically arranged pressurizing chambers disposed therein, wherein each pressurizing chamber comprises a substantially closed chamber end at one axial end and an open chamber end at an opposite axial end, and wherein the substantially closed chamber end is in hydraulic connection with a fluid transport passageway;

a pressurizing member disposed within each pressurizing chamber, the pressurizing member having a one-piece construction formed from a fluoropolymeric material and including:

a generally cylindrical body having a solid imperforate head at one body end that is positioned adjacent the substantially closed chamber end;

a thin-wall skirt extending radially outwardly a distance away from the body and extending axially away from the body head, the skirt having a outside surface and an oppositely directed inside surface; and a flange extending circumferentially around a terminal edge of the skirt;

a piston disposed axially within each pressurizing chamber and connected at one end to a respective pressurizing member opposite the body head, wherein each piston is independent of one another;

a piston gland attached to each pressurizing chamber open end and having an inside diameter that is complementary to that of the respective pressurizing chamber, wherein each piston gland includes a diametrically extending portion with a piston opening for accommodating a respective piston therethrough, and wherein each pressurizing member flange is interposed between respective pressurizing chambers and piston glands and includes sealing means to provide a fluid-tight seal therebetween to define a wetted area of the pump;

a pressurizing member plug attached to each pressurizing member and extending a distance axially away from the body head towards the respective piston, each plug having an outside wall surface that contacts and carries a variable portion of the respective skirt inside surface during reciprocating axial displacement of the pressurizing member;

wherein each pressuring member thin-walled skirt has sufficient axial length to roll between the plug outside wall surface and the gland inside diameter to permit reciprocating axial displacement of the pressurizing member within the pressurizing chamber; and means for actuating each piston independently of one another to cycle each pressurizing member within its respective pressurizing chamber.

17. The pump as recited in claim 16 further comprising means for sensing the position of each piston within the pump to actuate the pistons to provide a pulseless pump output pressure.

18. The pump as recited in claim 16 wherein the thin-walled skirt extends axially a distance away from the body head forming an annular channel between the skirt and the pressurizing member body, and wherein the pressurizing member plug is disposed within the annular channel and attached to the pressurizing member body.

19. A reciprocating pump for pressurizing high-purity process fluids, the pump having all wetted surfaces formed from non-metallic chemically inert materials, the pump comprising:

a housing having a hollow passageway extending therethrough;

a piston slidably disposed within the annular passageway;

a piston gland disposed at a housing end to accommodate placement of the piston therethrough to guide slidable displacement of the piston within the housing, the piston gland having at least one seal disposed along an outside surface to form an air- and liquid-tight seal against the annular passageway;

a pressurizing member plug connected at one end to an end of the piston and disposed adjacent a respective piston gland;

a pressurizing chamber assembly disposed at the housing end and comprising:

a chamber head connected to the housing end and including means for receiving and discharging process fluid; and a pressurizing member disposed within the chamber head having a generally cylindrical body including a solid imperforate nose portion and an integral hollow skirt extending axially therefrom, the pressurizing member and an inside surface of the chamber head forming a pressurizing chamber therebetween, wherein the body is attached to the pressurizing member plug and an inside surface of the hollow skirt is in contact with the pressurizing member plug, the hollow skirt having a flanged end that is interposed between the chamber head and the housing end to form a stationary air- and liquid-tight seal therebetween;

means for actuating the piston to produce reciprocating axial displacement of the piston within the passageway;

wherein the hollow skirt is of sufficient axial length so that when the piston is displaced to effect a pressurizing chamber maximum intake stroke the hollow skirt inside surface is in contact with the piston gland.

20. The pump as recited in claim 19 wherein the pump includes a pair of pistons, piston glands, pressurizing member plugs, and pressurizing chambers, and wherein the pair of pistons are attached together by a common shaft to provide a joined reciprocating axial displacement of each pressurizing member within a respective pressurizing chamber head.

21. The pump as recited in claim 19 wherein the pump includes a pair of pistons, piston glands, pressurizing member plugs, and pressurizing chambers, and wherein the pair of pistons are independent of one another to provide independent reciprocating axial displacement of each pressurizing member within a respective pressurizing chamber head.

22. The pump as recited in claim 19 further comprising means for detecting the position of each pressurizing member within a respective pressurizing chamber, and wherein said actuating means is designed to actuate each piston separately to provide a pulseless pump output pressure.

23. A reciprocating pump for pressurizing high-purity process fluids, the pump having all wetted surfaces formed from non-metallic chemically inert materials, the pump comprising:

a pump housing comprising a pair of hollow pressurizing chambers disposed therein, each chamber having a substantially closed end at one axial end and an open end at an opposite axial end, wherein the substantially closed end is connected to a fluid passageway;

a pressurizing member disposed within each respective pressurizing chamber, each pressurizing member comprising a generally cylindrical body having a solid imperforate at one axial end and a thin-walled skirt extending radially adjacently therefrom, wherein the skirt extends axially along the body to an opposite body axial end and defines an annular channel therebetween, wherein the skirt has an inside and outside surfaces and includes a flange that extends circumferentially around a terminal skirt edge;

a piston gland attached to each respective pressurizing chamber open end, wherein the flange is interposed between each respective piston gland and pressurizing member open end and includes means for providing a fluid-tight seal thereagainst, the piston gland including a diametrically extending portion having a piston opening therethrough;

a pump housing attached to each pressurizing chamber;

a piston axially movable within each pump housing and disposed through each respective gland piston opening, wherein each piston is attached to a pressurizing member opposite the body head, and wherein each piston is independent of one another;

a pressurizing member plug disposed within each annular channel and attached to a respective pressurizing member body, wherein each skirt inside surface is placed in contact against an outside surface of a respective plug for support; and means for actuating each piston to effect independent axial displacement of each pressurizing member within a respective pressurizing chamber;

wherein pressurizing member axial displacement within each respective pressurizing member is permitted by rolling movement of each thin-walled skirt between opposed plug and gland surfaces.

24. The pump as recited in claim 23 further comprising a fluid inlet port and a fluid outlet port each in hydraulic communication with the pressurizing chamber fluid passageway, wherein the fluid outlet and inlet port each include checkvalves attached thereto for controlling fluid passage through the pressurizing chamber.

25. The pump as recited in claim 24 wherein the checkvalves are of modular construction comprising:

a module top cap that is removable attached to the pump housing;

a checkvalve body that is rotatably attached to the module cap at one checkvalve body end, wherein the checkvalve body includes a fluid flow port disposed therein to facilitate fluid flow through the checkvalve body, wherein the fluid flow port includes a valve seat at one end;

a checkvalve body cap attached to the checkvalve body at an end opposite the module top cap, wherein the checkvalve body cap includes a fluid flow port and valve seat for passing fluid from the checkvalve body valve seat to the pressurizing chamber fluid passageway;

a non-metallic checkvalve interposed between the checkvalve body valve seat and checkvalve body cap valve seat and designed to permit flow in one direction through the checkvalve body; and means for positioning the checkvalve body within the pump housing to ensure alignment of the checkvalve body fluid flow port.

* * * * *